US005989057A

United States Patent [19]

Gerke et al.

[11] Patent Number: 5,989,057

[45] Date of Patent: Nov. 23, 1999

[54] CONNECTOR MODULE WITH CUTTING CLAMPING ELEMENT

[75] Inventors: Dieter Gerke; Frank Mössner, both of Berlin, Germany

[73] Assignee: Krone Aktiengesellschaft, Berlin, Germany

[21] Appl. No.: 08/911,314

[22] Filed: Aug. 19, 1997

[30] Foreign Application Priority Data

Oct. 15, 1996 [DE] Germany ..... 196 42 445

[51] Int. Cl.[6] ..... H01R 4/24

[52] U.S. Cl. ..... 439/417; 439/397

[58] Field of Search ..... 439/417, 449, 439/402, 403, 404, 405, 397

[56] References Cited

U.S. PATENT DOCUMENTS

| | | | |
|---|---|---|---|
| 4,547,034 | 10/1985 | Forberg et al. | 439/404 |
| 5,006,960 | 4/1991 | Kallin et al. | 439/449 |
| 5,131,863 | 7/1992 | Gerke et al. | 439/395 |
| 5,352,854 | 10/1994 | Comerci et al. | 439/449 |
| 5,537,471 | 7/1996 | Smith | 439/417 |
| 5,588,869 | 12/1996 | Jensen et al. | 439/417 |
| 5,597,321 | 1/1997 | Jacques | 439/417 |
| 5,620,332 | 4/1997 | Gerke et al. | 439/417 |
| 5,681,182 | 10/1997 | Reichle | 439/417 |

FOREIGN PATENT DOCUMENTS

| | | |
|---|---|---|
| 0 297 698 | 1/1989 | European Pat. Off. . |
| 0 459 144 | 6/1996 | European Pat. Off. . |
| 26 10 461 | 8/1980 | Germany . |
| 93 13797 | 5/1995 | Germany . |
| 44 37 022 | 2/1996 | Germany . |
| 44 42 673 | 6/1996 | Germany . |

*Primary Examiner*—Paula Bradley
*Assistant Examiner*—Tho Dac Ta
*Attorney, Agent, or Firm*—McGlew and Tuttle, P.C.

[57] ABSTRACT

A connection element having electric insulation-piercing terminal contact elements in a chamber of a receptacle part intended for the connection of electric conductors without stripping them. A sliding part is provided enclosing a part of the insulation-piercing terminal contact elements arranged in the chamber. The connection element permits easy and reliable connection of electrical insulated conductors without a special connecting tool and at the same time ensures as high a current-carrying capacity of the conductor as possible. A locating opening for the conductors is made in a sliding part 1 in an inclined position relative to the longitudinal axis of the sliding part, which longitudinal axis is at the same time the longitudinal axis of the chamber. The conductors are inserted into the insulation-piercing terminal connecting contacts, set at an angle to the wall of the chamber, and make electrical contact with the insulation-piercing terminal connection contacts.

18 Claims, 6 Drawing Sheets

FIG.4a
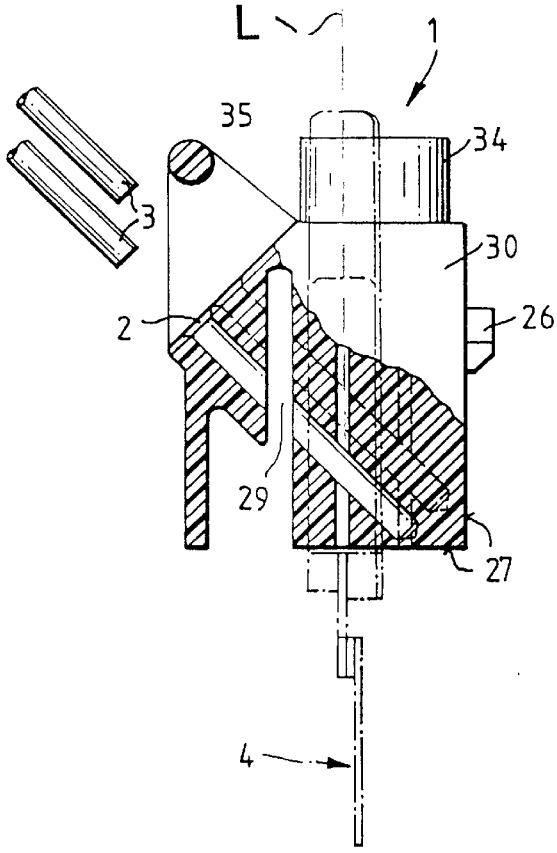
FIG.4b
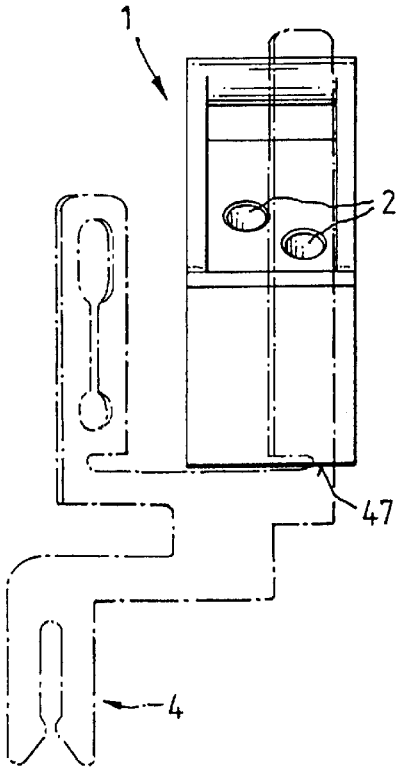
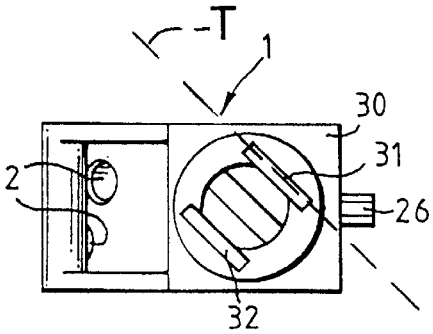
FIG.4c

CONNECTOR MODULE WITH CUTTING CLAMPING ELEMENT

FIELD OF THE INVENTION

The invention relates to a connection element having electrical insulation piercing terminal contact elements in the chamber of a receptacle part intended for the connection of electric conductors without stripping them.

BACKGROUND OF THE INVENTION

A connection block for connecting insulated electric conductors to electric contacts in an insulation-piercing terminal connection technique by means of a sealed connector is described in German Utility Model 93 13797. In the disclosed connection block there are arranged chambers and blocks which are open at the top, are fitted with continuous insulation-piercing terminal contacts in a 45° position and enable the connection block to be connected on two sides. The connection is effected on the user side by means of the sealed connector belonging to the connection block.

The contact is made by the movement of the sealed connector, which has to be pushed through by finger pressure. This finger pressure may lead to symptoms of fatigue in the operator in the case of larger wire diameters and during connecting or disconnecting actions to be carried out repeatedly one after the other.

A clamping connector is described in DE 26 10 461 in which the insulated electric conductor is put through the bore of a plastic sleeve and is pushed with the latter onto a slit connection element by means of a flat tab. In this case, the cable strand is not pushed into the slot of the connection element perpendicularly to the slot as hitherto but in such a way as to be arranged obliquely at an angle of 45°. The connection element is arranged rectilinearly or parallel to the side walls.

A connection element is described in DE 44 37 022 Cl having electric contacts. The electric contacts are used in an insulation piercing terminal connection technique in chambers of a receptacle part intended for the connection of electric conductors without stripping them and having openings for locating the electric conductors.

A sliding part is put into the chamber of the receptacle part, which sliding part encloses a part of the insulation-piercing terminal contact elements arranged in the chamber. The electric conductor with which electrical contact is to be made is guided through the locating openings rectilinearly or parallel to the side walls of the sliding part onto the insulation piercing terminal contact arranged in a 45° position and is pressed into the contact slot by the movement of the sliding part.

SUMMARY AND OBJECTS OF THE INVENTION

The primary object of the invention is to develop a connection element of the type having electrical insulation piercing terminal contact elements in the chamber of a receptacle part intended for the connection of electrical conductors without stripping them, which permits easy and reliable connection of electrically insulated conductors without a special connecting tool and at the same time ensures as low a mechanical load as possible and as high a current carrying capacity of the conductor as possible.

According to the invention, a connection element having electrical insulation piercing terminal contact elements is provided. The electrical insulation piercing terminal contact elements are provided in a chamber of a receptacle part intended for the connection of electrical conductors without stripping them. The receptacle part is provided with a sliding part with at least one opening for locating the electrical conductors. The sliding part encloses a part of the insulation-piercing terminal contact elements arranged in the chamber. A locating opening for the conductor is provided in the sliding part in an inclined position relative to a longitudinal axis of the sliding part, which longitudinal axis is at the same time the longitudinal axis of the chamber. The conductor is inserted into the insulation-piercing terminal connecting contact, set at an angle to the wall (longitudinal axis) of the chamber, and makes-electrical contact with the insulation-piercing terminal connecting contact.

The provision of inclined locating openings for the electric conductor in the sliding part in combination with the obliquely arranged insulation-piercing terminal connecting contacts in the chamber of the receptacle part results in a substantial increase in the electrical contact-making area and thus in an increase in the possible current-carrying capacity.

The notch effect is further reduced and thus the mechanical load on the conductor is reduced by the extended axial offset of the contact notches on the conductor as a result of the oblique insertion of the conductor and the contacts set at an angle.

Due to the offset arrangement of the locating openings for the electric conductors, simple and reliable connecting of the insulation-piercing terminal contact elements without a special connecting tool is ensured without greater expenditure of force. Even relatively large wire diameters can be connected and disconnected repeatedly without the person making the connections becoming tired through the force which has to be exerted.

The locating opening is preferably made in a 45° position relative to the longitudinal axis of the sliding part. The conductor may be inserted into the insulation-piercing terminal connecting contact, arranged in a 45° position relative to the wall of the chamber. The conductor thereby makes electrical contact with the insulation-piercing terminal connecting contact.

The sliding part can be locked in the chamber of the receptacle part. The receptacle part may have clamping slots for the strain relief of the inserted insulated electric conductors.

Preferably the receptacle part provides at least two chambers of are arranged next to one another in a row with at least two sliding parts. The receptacle part can be latched onto a supporting part and combined with further function modules such as other receptacle parts.

Each sliding part preferably has two locating openings for the electric conductors.

The insulation-piercing connecting contact is preferably formed from a first closed, self-supporting insulation piercing terminal contact in a 45° position. The contact preferably has a contact slot which connects two bores to one another, from a second closed, self-supporting insulation-piercing terminal contact in a 45° position, having a contact slot which connects two further bores to one another, and from a fork contact having a contact slot. The insulation piercing terminal contacts and the fork contact preferably are connected to one another in one piece via a web. Preferably, in each case, one of the bores of the first and second insulation-piercing terminal contact of the insulation-piercing terminal contact element are elongated holes having entry bevels. The connection element preferably a pick-off formed on a free end of the one insulation-piercing terminal contact of the insulation-piercing terminal contact element.

The invention is described in more detail below with reference to an exemplary embodiment of a connection element having four conductor entries and shown in the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 4*a* shows the side view of the sliding part in sectional representation;

FIG. 4*b* shows the perspective front view of the sliding part;

FIG. 4*c* shows the plan view of the sliding part;

DESCRIPTION OF THE PREFERRED EMBODIMENT

Figure 1:
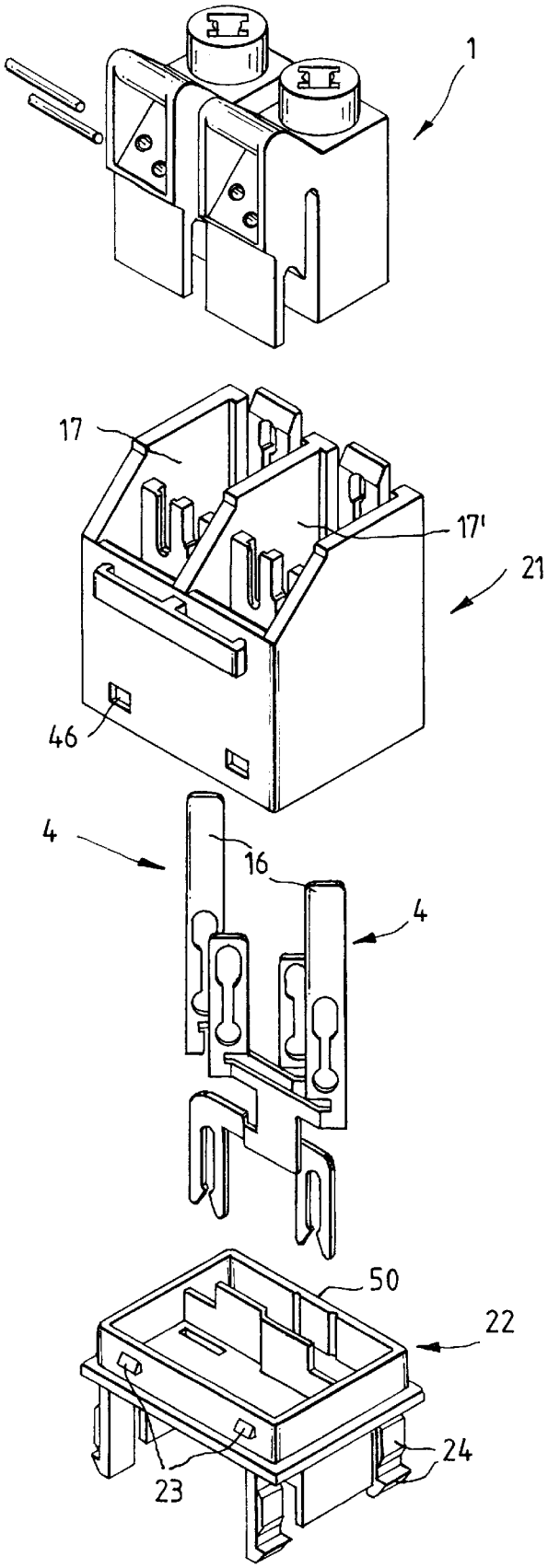
FIG. 1 shows the exploded representation of the parts of the connection element.

Referring to the drawings in particular, the invention comprises a connection element as shown in FIG. 1. The connection element includes a sliding part 1, a top part 21, a bottom part 22, and an insulation piercing terminal connecting contact 4. The top part 21 and the bottom part 22 form a receptacle part 18 into which the insulation-piercing terminal contact element 4 is inserted.

Figure 5:
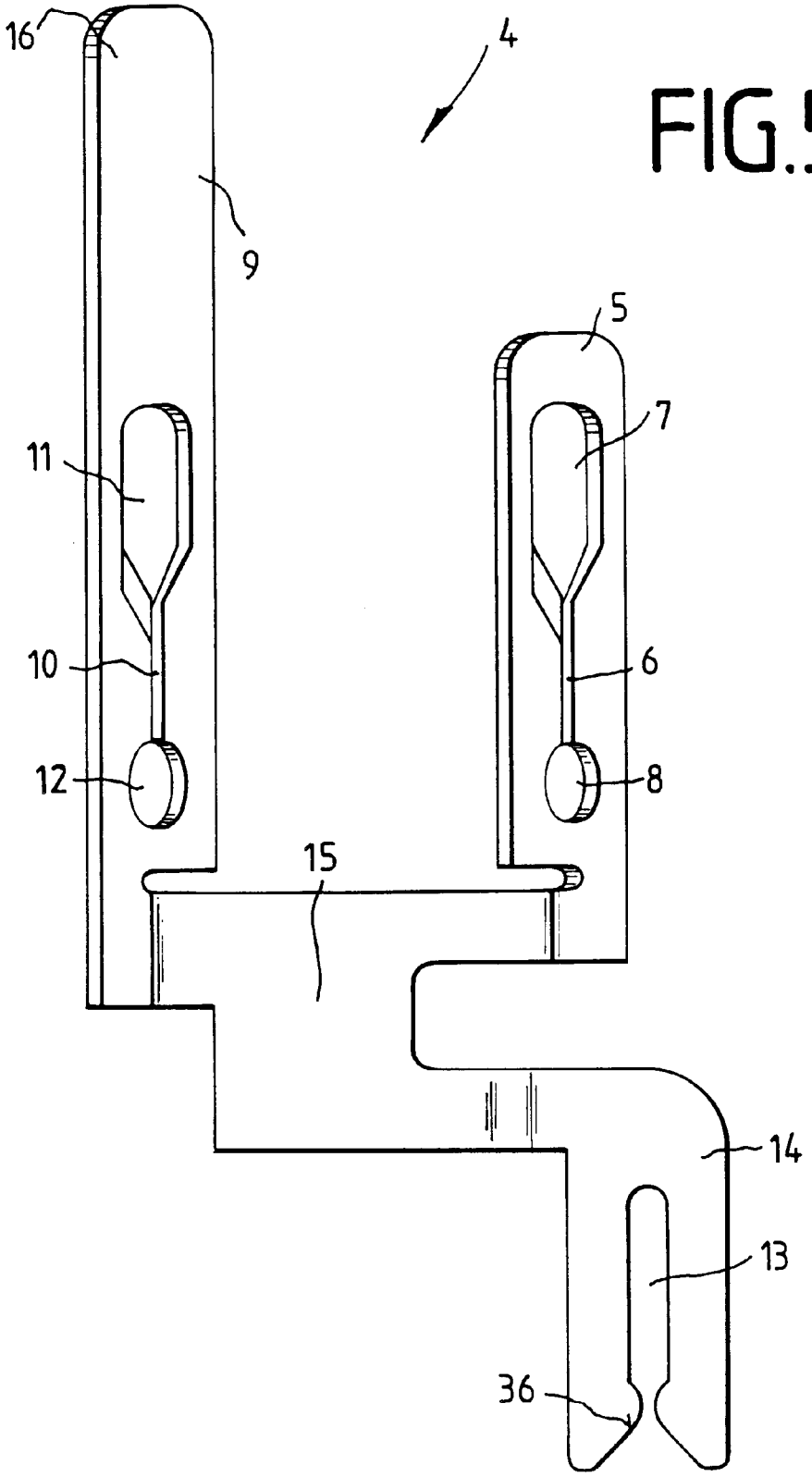
FIG. 5 shows the front view of an insulation-piercing terminal connecting contact.

The insulation-piercing terminal connecting contact 4 as shown in FIG. 5 includes insulation-piercing terminal contacts 5, 9 and a fork contact 14 which are connected to one another in one piece via a web 15.

The insulation-piercing terminal contact 5 contains two bores 7, 8 which are connected to one another via a contact slot 6. The bore 7 forms an elongated hole having entry bevels.

The insulation-piercing terminal contact 9 has two bores 11, 12 which are connected to one another via a contact slot 10, the bore 11 being formed as an elongated hole having entry bevels. The insulation piercing terminal contact 9 is extended upwards to form a pick-off 16, for example for test equipment.

The design of the bores 7, 11 as elongated hole ensures the reliable entry of the cable strands 3 via the inclined locating openings 2 in the sliding part 1 (FIGS. 4*a* to 4*c*).

Figure 3A:
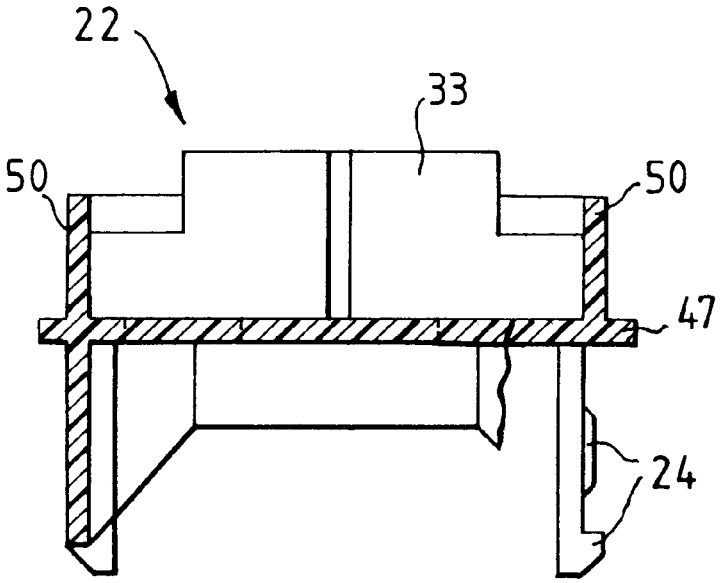
FIG. 3*a* shows the front view of the bottom part of the receptacle part (sectional representation)

The insulation-piercing terminal contacts 5, 9 are closed, self-supporting insulation-piercing terminal contacts and are each arranged (formed) in a 45° position relative to the connecting web 15. The fork contact 14, bent downwards from the web and running in a plane in parallel with the web 15, is an open pick-off having a contact slot 13. With the entry bevels 36 of its contact slot 13 pointing downwards, the fork contact 14 is freely accessible from the base 47 of the bottom part 22 of the receptacle part 18 (FIG. 3*a*) and serves, for example, to make electrical contact with a contact path (not shown).

In the present example, the two insulation-piercing terminal contact elements 4 according to FIG. 5 are inserted into the two chambers 17, 17' of the receptacle part 18. This is in such a way that in each case the insulation-piercing terminal connecting contact 9 plunges, with the pick-off 16 of the one insulation-piercing terminal contact element 4, into one of the chambers 17, 17' and its insulation-piercing terminal connecting contact 5 plunges into the other adjacent chamber 17, 17' and vice versa (FIGS. 1, 7).

Figure 7:
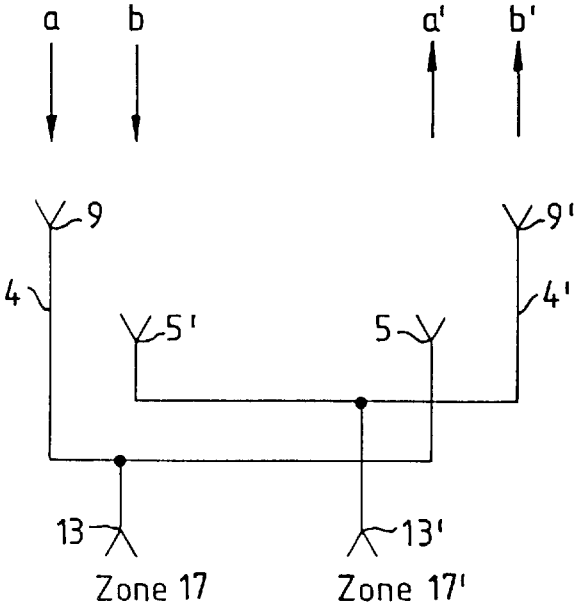
FIG. 7 shows the diagrammatic representation of the connection contacts according to FIG. 5 inserted into the sliding part.

According to the representation in FIG. 7, an incoming cable strand a is connected to an outgoing cable strand a', via the insulation-piercing terminal contact 9 of the insulation-piercing terminal connecting contact 4 in the chamber 17 and via the insulation-piercing terminal contact 5 of the insulation-piercing terminal connecting contact 4 in the chamber 17' of the receptacle part 18. In an analogous manner, the connection of the cable strands b, b', is effected via the contacts 9', 5' of the connection contact 4'.

Figure 2B:
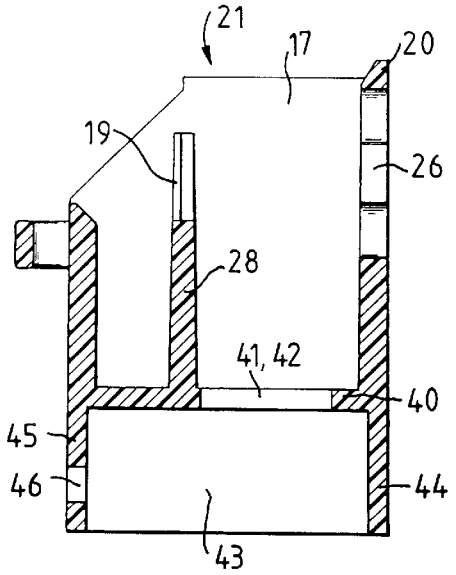
FIG. 2*b* shows the side view of the top part of the receptacle part (sectional representation)
Figure 2A:
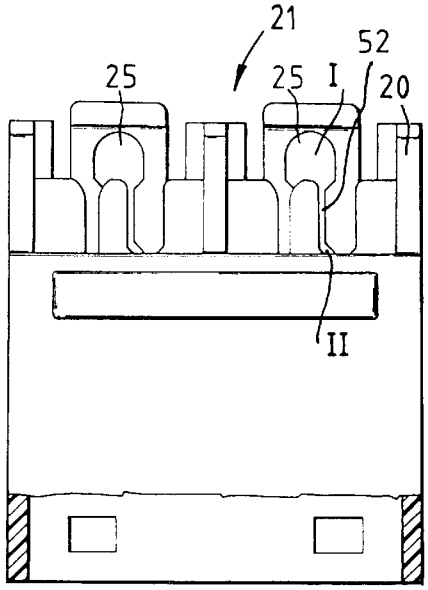
FIG. 2*a* shows the front view of the top part of the receptacle part.

According to the representations in FIGS. 1 and 2*b*, the receptacle part 18 is formed from the top part 21 (FIGS. 1, 2*a* to 2*c*) and the bottom part 22 (FIGS. 1, 3*a*, 3*b*), which are connected to one another via latch devices 23 (FIG. 1), the bottom part 22 having further latch devices 24 (FIGS. 1, 3*a*) for latching in place on a supporting part (not shown).

The top part 21 of the receptacle part 18 (FIGS. 1, 2*a* to 2*c*) has the two chambers 17, 17' open at the top. Each of the chambers 17, 17' is formed according to FIGS. 2*a*, 2*b* from a slotted rear wall 20 of flexible design. The chambers 17, 17' have a closed slot 25 for locating the latch device 26 of the sliding part 1 (FIGS. 4*a* to 4*c*), from two side walls 37, 38 (FIG. 2*b*), of which the one side wall 38 forms the dividing wall to the adjacent chamber 17, from a front wall 39, and from a base plate 40 (FIGS. 2*b*, 2*c*) common to both chambers 17, 17', and having two bores 41, 42 in order to put through the two insulation piercing terminal contact elements 4 from below. The base plate 40 is made at such a level that a space 43 remains free below it at the level of the connecting web 15 of the insulation-piercing terminal contact element 4. The latch openings 46 (FIGS. 1, 2*b*) for the latch elements 23 (FIG. 1) on the bottom part 22 are recessed in the opposite two outer boundaries 44, 45 of this space 43.

Figure 2C:
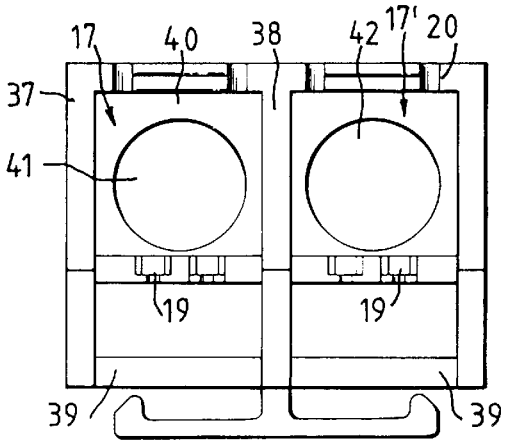
FIG. 2*c* shows the plan view of the top part of the receptacle part.
Figure 3B:
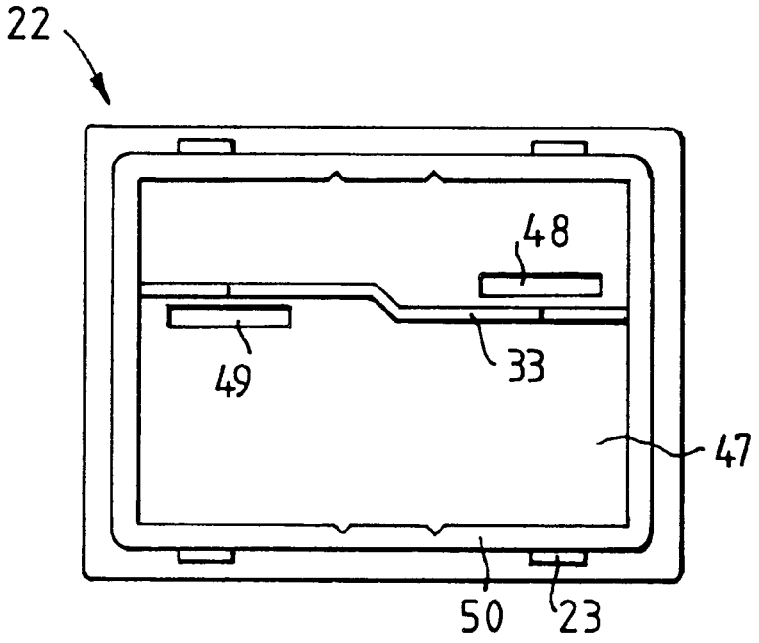
FIG. 3*b* shows the plan view of the bottom part of the receptacle part.

Furthermore, the chambers 17, 17' each have an intermediate wall 28 with slots 19 for the strain relief of the cable strands 3 to be inserted (FIGS. 1, 2*b*, 2*c*).

The bottom part 22 (FIGS. 1, 3*a*, 3*b*) is formed from a base plate 47 having leadthroughs 48, 49 (FIG. 3*b*) for the fork contacts, 13' of the two insulation-piercing terminal contact elements 4', from upwardly pointing webs 50 (FIGS. 1, 3*a*, 3*b*), which are partly provided with the latch devices 23 for the connection to the top part 21, and from the downwardly pointing latch devices 24 for the releasable connection to the supporting part (not shown).

The leadthroughs 48, 49 (FIG. 3*b*) are isolated from one another by the intermediate wall 33, which is designed in accordance with the web geometry of the insulation-piercing terminal contact element 4. The intermediate wall 33 separates the webs 15, bearing on both sides against the intermediate wall 33, of the two insulation-piercing terminal contact elements 4.

According to the representation in FIGS. 1, 4*a* to 4*c*, the sliding part 1 is made in one piece from an insulating material.

According to FIGS. 4*a*, 4*b*, the sliding part 1 has the two locating openings 2. These openings 2 are made as inclined blind holes down to a stop wall 27 and in the process cross a recess 29. As shown in FIG. 4*a*, the blind holes 2 position the wires 3 at an inclination to a plane of the contact element 4 in two substantially perpendicular directions. The intermediate wall 28 of the top part 21 (FIG. 2*b*), having the slots 19 for the strain relief of the cable strands 3, plunges into the recess 29 when the sliding part 1 is inserted into the receptacle part 18 from above.

Furthermore, the sliding part 1 has a receptacle for the insulation-piercing terminal contact element 4. According to the representation in FIG. 4*c*, the receptacle 30 has through-slots 31, 32 into which parts of the two insulation-displacement connection elements 4 plunge from below (not shown) and via which signals can be picked off.

The latch element 26 is arranged on the receptacle 30, which latch element 26 interacts with the closed slot 25 in the divided and flexible rear wall 20 of the chamber 17 of the receptacle part 18 (FIG. 2*a*).

As the plan view of the sliding part 1 in FIGS. 4*b*, 4*c* shows, the locating openings 2 are arranged offset to the rear. Consequently, the conductors 3, when pressed in, do not make electrical contact with the connection contacts 4 simultaneously but one after the other, so that a reduced expenditure of force is necessary. To facilitate the release of the sliding part 1 from the connecting position, a stirrup 35 is provided, behind which a suitable tool for levering out the sliding part 1 can be pushed if need be.

The dome 34 (FIG. 4*a*) of the sliding part 1 can be covered by a cap plug (not shown), which also facilitates, inter alia, the pushing in of the sliding part 1.

To connect the connection element, the sliding part 1 is put into the connecting position I (FIG. 2*a*). The connecting position I is defined by a contraction 52, acting as a stop, in the slot 25 of the rear wall 20 of the chamber 17 (FIG. 2*a*). In the connecting position I, the openings 2 in the sliding part 1 coincide with the bore 7 in the one insulation-piercing terminal contact element 4 and with the bore 11 in the other insulation piercing terminal contact element 4; electric conductors 3, e.g. cable strands a, of a telecommunications cable, can be inserted from outside down to the stop wall 27 on the sliding part 1.

After the electric conductor 3 is inserted into the opening 2 in the receptacle part 18 down to the stop against the stop wall 27, the sliding part 1 is moved manually downwards into position II (FIG. 2*a*). In the process, the inserted electrical conductors 3 are moved out of the bores 7 and 11 respectively in the two insulation-piercing terminal contact elements 4 into the contact slots 6 and 10 respectively in the insulation-piercing terminal contact elements 4 (FIG. 5) and make electrical contact with the latter. In this position II, the sliding part 1 is interlocked in the chamber 17 in order to prevent unintentional release (not shown).

Figure 6:
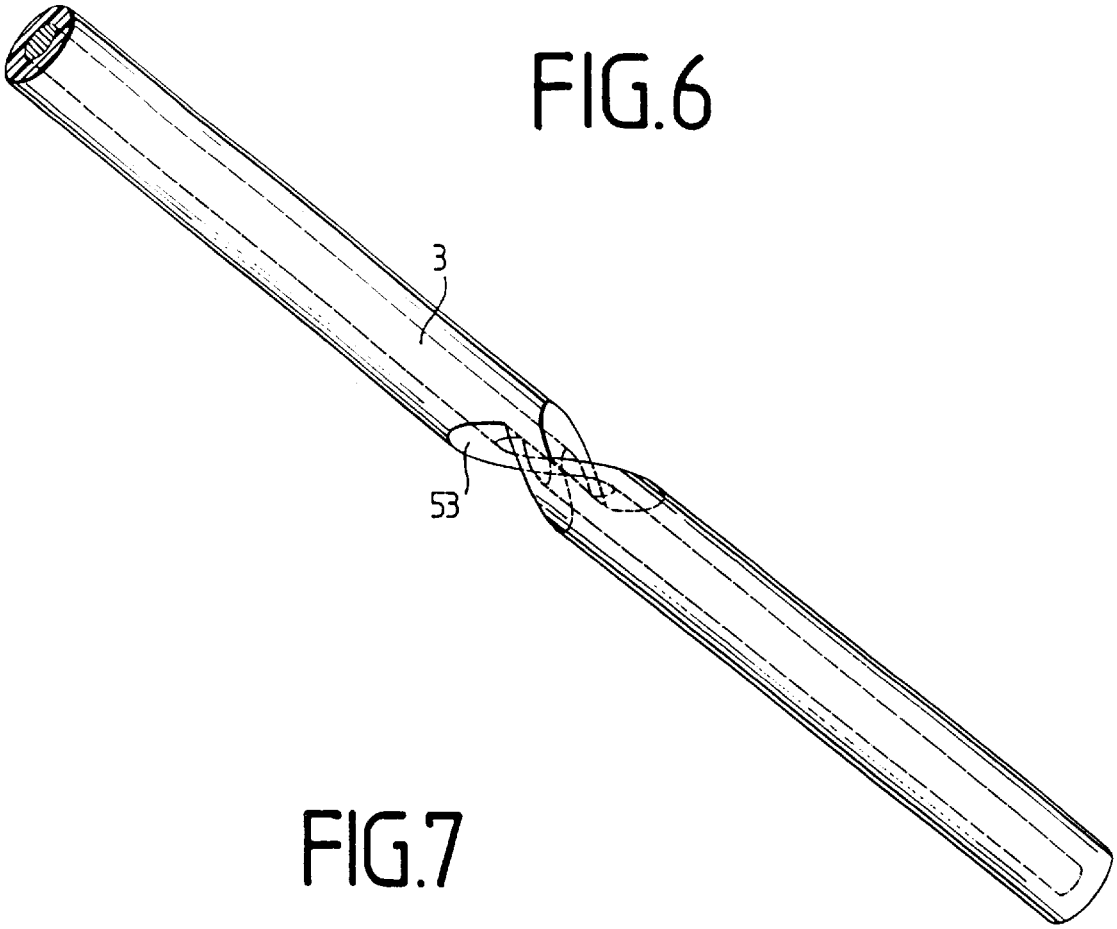
FIG. 6 shows the schematic representation of the contact area on a cable strand.

Due to the inclined locating openings 2 for the electrical conductors 3 in the sliding part 1, a substantial increase in the electrical contact-making area 53 on the conductor 3 is achieved in combination with the obliquely arranged insulation-piercing terminal connecting contacts 4 in the chambers 17 of the receptacle part 18 (FIG. 6). Furthermore, the representation in FIG. 6 shows the contact notches, axially offset compared with the known connections, on the electric conductor 3.

During disconnection, the interlocking is released and the sliding part 1 is moved back into the first position I. In the process, the conductors 3 are also moved back into the bores 7 and 11 respectively in the insulation-piercing terminal contact elements 4, from which the conductors 3 can be removed.

The connection element may also be designed as a connection strip.

Any number of connection elements may be mounted side by side; e.g. four or five connection elements in the present exemplary embodiment are mounted side by side for an 8 or 10 twin-core strip. One connection element serves to connect two twin cores.

Sliding parts 1 having one locating opening 2 for the electric conductors 3 may also be used, in which insulation-displacement connection elements 4 of appropriate design are then used. The sliding parts 1 having one locating opening 2 may be mounted side by side as desired and, in addition to being used in telecommunications and data systems, may also be used, for example, in metrology and test engineering.

While a specific embodiment of the invention has been shown and described in detail to illustrate the application of the principles of the invention, it will be understood that the invention may be embodied otherwise without departing from such principles.

| | |
|---|---|
| 1 | Sliding part |
| 2 | Locating opening |
| 3 | Conductor (cable strand) |
| 4, 4' | Insulation-piercing terminal connecting contact |
| 5, 5' | Insulation-piercing terminal contact |
| 6 | Contact slot |
| 7 | Bore |
| 8 | Bore |
| 9, 9' | Insulation-piercing terminal contact |
| 10 | Contact slot |
| 11 | Bore |
| 12 | Bore |
| 13 | Contact slot |
| 14 | Fork contact (pick-off) |
| 15 | Web |
| 16 | Pick-off |
| 17, 17' | Chamber |
| 18 | Receptacle part |
| 19 | Clamping slot |
| 20 | Rear wall |
| 21 | Top part |
| 22 | Bottom part |
| 23 | Latch device |
| 24 | Latch device |
| 25 | slot |
| 26 | Latch device |
| 27 | Stop wall |
| 28 | Intermediate wall |
| 29 | Recess |
| 30 | Receptacle |
| 31 | slot |
| 32 | Slot |
| 33 | Intermediate wall |
| 34 | Dome |
| 35 | Stirrup |
| 36 | Entry bevel |
| 37 | Side wall |
| 38 | Side wall |
| 39 | Wall |
| 40 | Base plate |
| 41 | Bore |

-continued

| | |
|---|---|
| 42 | Bore |
| 43 | Space |
| 44 | Boundary |
| 45 | Boundary |
| 46 | Latch opening |
| 47 | Base plate |
| 48 | Leadthrough |
| 49 | Leadthrough |
| 50 | Web |
| 51 | |
| 52 | Contraction |
| 53 | Electrical contact-making area |
| I | Connecting position |
| II | Connecting position |
| a, a' | Cable strand |
| b, b' | Cable strand |

What is claimed is:

1. A connection element for the connection of electrical conductors without stripping the electric conductors, the connection element comprising:

a receptacle part forming a chamber;

an electrical insulation piercing terminal contact element in said chamber;

a sliding part with a conductor locating opening for positioning an electrical conductor, said sliding part enclosing a part of said insulation-piercing terminal contact element, said locating opening being provided in the sliding part in an inclined position relative to a longitudinal axis of said sliding part, said longitudinal axis also being a longitudinal axis of said chamber, said sliding part and said opening defining positioning means for positioning the conductor inserted into said insulation-piercing terminal contact element at an angle relative to said longitudinal axis of said chamber for making electrical contact with said insulation-piercing terminal contact element, said positioning means also positions the wire angularly with respect to a transverse direction of said contact element, said transverse direction being substantially perpendicular to said longitudinal axes.

2. The connection element as claimed in claim 1, wherein said locating opening includes a bore extending at a 45° angle relative to said longitudinal axis of said sliding part, and wherein the conductor is inserted into said insulation-piercing terminal contact element, arranged in a 45° position relative to said wall of said chamber, and makes electrical contact with the insulation-piercing terminal contact element.

3. The connection element as claimed in claim 1, further comprising: locking means for locking said sliding part in said chamber of said receptacle part.

4. The connection element as claimed in claim 1, wherein said receptacle part has clamping slots for strain relief of an insulated electric conductor inserted into said insulation-piercing terminal contact element.

5. The connection element as claimed in claim 1, wherein said receptacle part has two chambers arranged next to one another in a row with two associated sliding parts.

6. The connection element as claimed in claim 1, wherein said receptacle part includes means for latching said receptacle part onto a supporting part for combining said receptacle part with further function modules.

7. The connection element as claimed in claim 1, wherein said sliding part has two locating openings, each for receiving an electric conductor.

8. The connection element as claimed in claim 1, wherein the insulation-piercing terminal contact element includes:

a first closed, self-supporting insulation piercing terminal contact at a 45° angle relative to a receptacle part wall, said first closed contact having a contact slot which connects two bores to one another;

a second closed, self-supporting insulation-piercing terminal contact at a 45° angle relative to a receptacle part wall, said second closed contact having a contact slot which connects two further bores to one another;

a fork contact having a contact slot; and a web, said first closed contact and said second closed contact and said fork contact being connected to one another in one piece via said web.

9. The connection element as claimed in claim 8, wherein one of said bores of said first and second closed contacts are elongated holes having entry bevels.

10. The connection element as claimed in claim 8, wherein a pick-off is formed on a free end of one of said first and second closed contacts.

11. A connection element for the connection of electrical conductors without stripping the electric conductors, the connection element comprising:

a receptacle part forming a chamber;

an electrical insulation piercing terminal contact element in said chamber, said insulation-piercing terminal contact element defining an insertion direction;

a sliding part with a conductor locating opening for positioning an electrical conductor, said sliding part enclosing a part of said insulation-piercing terminal contact element, said locating opening being provided in the sliding part in an inclined position relative to a longitudinal axis of said sliding part, said longitudinal axis also being a longitudinal axis of said chamber, said sliding part and said opening defining positioning means for positioning the conductor in said insulation-piercing terminal contact element at an angle to said insertion direction of said insulation-piercing terminal contact element, said positioning means also positions the wire angularly with respect to a transverse direction of said contact element, said transverse direction being substantially perpendicular to said insertion direction.

12. A connection element for the connection of electrical conductors, the connection element comprising:

a receptacle part forming a chamber;

an electrical insulation piercing terminal contact element in said chamber;

a sliding part insertable into said chamber, said sliding part defining a conductor locating opening for positioning an electrical conductor in said contact element with a longitudinal axis of the wire being angularly positioned between 0 and 90 degrees to a first direction of said contact element, and angularly positioned between 0 and 90 degrees to a second direction of said contact element, said first and second directions of said contact element being substantially perpendicular to each other.

13. The connection element in accordance with claim 12, wherein:

said contact element is substantially planar;

said first and second directions are in a plane of said contact element.

14. The connection element in accordance with claim 12, wherein:

said contact element defines a contact slot with a longitudinal direction substantially parallel to said first direction.

15. The connection element in accordance with claim 12, wherein:

said wire is positioned at substantially 45 degrees with respect to said first and second directions.

16. The connection element in accordance with claim 12, wherein:

said sliding part is movable between a first and second position for electrically connecting and disconnecting the wire from said contact element.

17. The connection element in accordance with claim 14, wherein:

said sliding part moves in said first direction between said first and second positions.

18. The connection element in accordance with claim 15, wherein:

said contact element defines a contact slot with a longitudinal direction substantially parallel to said first direction;

the wire is electrically connected to said contact slot in said second position.

* * * * *